United States Patent [19]

Custer

[11] Patent Number: 4,663,841

[45] Date of Patent: May 12, 1987

[54] HAIR TRIMMING TOOL

[76] Inventor: Harry W. Custer, 30635 Helmandale Dr., Franklin, Mich. 48025

[21] Appl. No.: 826,480

[22] Filed: Feb. 5, 1986

[51] Int. Cl.[4] ..... B26B 21/12

[52] U.S. Cl. ..... 30/30; 30/63

[58] Field of Search ..... 30/30, 31, 63, 79, 78

[56] References Cited

U.S. PATENT DOCUMENTS

| | | | |
|---|---|---|---|
| 942,298 | 12/1909 | Walter | 30/30 |
| 1,456,432 | 5/1923 | Froh | 30/30 |
| 1,789,234 | 1/1931 | Keenan | 30/30 |
| 2,462,519 | 2/1949 | Mansfield | 30/30 |
| 2,955,355 | 10/1960 | Tornvall | 30/30 |
| 3,183,589 | 5/1965 | Szabo | 30/30 |
| 3,523,364 | 8/1970 | Crisanti | 30/30 |
| 3,699,653 | 10/1972 | Miller | 30/30 |
| 3,754,325 | 8/1973 | Tornvall | 30/30 |
| 3,986,258 | 10/1976 | Liedtke | 30/30 |

FOREIGN PATENT DOCUMENTS

| | | | |
|---|---|---|---|
| 118110 | 2/1944 | Australia | 132/19 |

*Primary Examiner*—Douglas D. Watts

*Attorney, Agent, or Firm*—Peter D. Keefe

[57] ABSTRACT

A hair trimming tool having means to adjust the cutting depth. The invention is a lightweight, compact, adjustable, razor blade type, hand-held hair trimmer tool having a stationary base member for removably affixing a standard safety razor blade and a slidable base member for adjusting the length of cut. Comb-like teeth projections on both base members ensure a controlled, even cut.

5 Claims, 3 Drawing Figures

HAIR TRIMMING TOOL

BACKGROUND OF THE INVENTION

The invention relates to hair trimming tools, more particularly to a hand-held hair trimmer having adjustable length comb teeth and employing replaceable safety razor blades.

There has been a long standing need in the art pertaining to hand-held, razor blade based hair trimmers, to provide a simple, inexpensive, effective means for the user to satisfactorily trim his or her own hair. Past efforts have centered upon utilization of a double-edge type safety razor blade attached to a base having a comb-like structure emanating from a base surface parallel with the blade edge. U.S. Pat. No. 1,456,432 to Froch is exemplary, wherein is disclosed a typical trimmer structure further having a slidable mounting provision for the blade, permitting adjustability of the cutting edge into the comb teeth structure.

In all these past attempts there has remained the need to provide a trimmer device which takes account of all the difficulties incident to personal, private use. The typical user is unskilled in barbering technique, has limited sight, and, generally, limited control over the cutting process. There remains a very real and constant danger of accidental cutting of hair too short—a danger which demands that the only practical trimmer of this type be very lightweight, extremely compact and readily adjustable.

It is an object, therefore, of the present invention to provide a hand-held hair trimming tool which is very inexpensive, rugged and easily maintained.

These and other objects and features of the invention will become apparent from the following description of the invention.

SUMMARY OF THE INVENTION

The present invention is comprised of two base members, one of which is stationary and the other of which is slidably mounted thereupon. The stationary base member has provision for mounting, in fixed position, a standard safety razor blade utilizing two bosses adapted to fit into the standard apertures provided on the blade. The two base members are secured together by a bolt attached to the stationary base member which extends beyond the slidable base member, through a travel defining slot, and tightened by a knurled knob nut. Parallel movement of the slidable base member is assured by means of two bosses on the inside facing surface of the stationary base member, spaced directly back from the attaching bolt and equally separated as the blade holding bosses, in concert with two parallel elongated cavities on the inside surface of the slidable base member adapted for cooperative fit with the aforementioned bosses. Importantly, each of the base members terminates forwardly with comb-type teeth projections; that on the slidable base member being larger than that on the stationary base member so that the projections are equidistant from the blade edge for each base member when the slidable base member is fully retracted.

In operation, the user unscrews the knurled knob, separates the base sections, inserts a razor blade, reassembles the base members, and before tightening the knurled knob adjusts the slidable base member for best comb teeth projectivity, depening on whether coarse or fine trimming action is desired. Further adjustments in comb teeth length are easily effected during the trimming session by mere loosening of the knurled knob and movement of the slidable base member.

DETAILED DESCRIPTION OF THE PREFERRED EMBODIMENT

Figure 1:
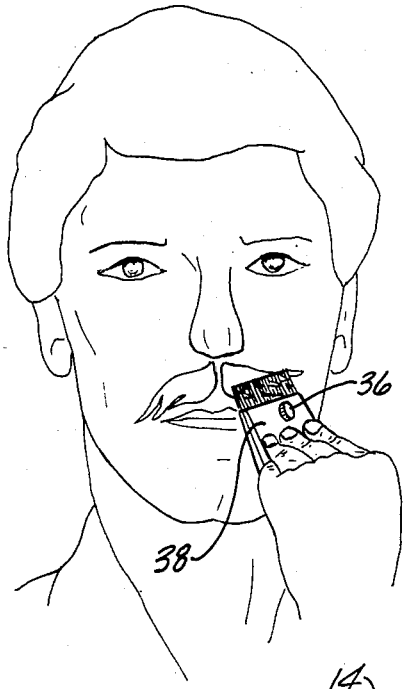
FIG. 1 shows the invention generally being utilized by a user, in this case for the purpose of trimming a mustache.

Referring now to the figures, FIG. 1 shows generally the way in which the present invention is used to effect hand-held hair trimming by the user on himself. It is clear that controlled and safe trimming can only be accomplished if the user has a full view of the area being cut. A most practical and effective use of the present invention is to trim side hair, mustache and beard. In the event that head hair generally is to be trimmed, it will be appreciated from the figure that the very light, compact, easily held trimmer, as shown, is essential to achieve a quality cut, especially in the face of the need for somewhat awkward hand movements in trimming hair more rearwardly on the head.

Figure 2:
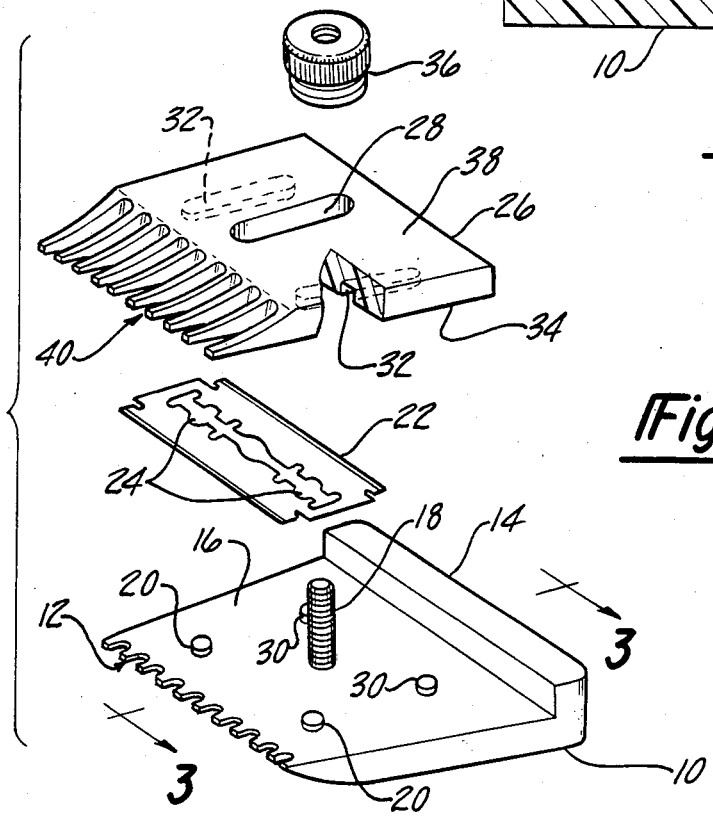
FIG. 2 is an exploded view of the invention showing generally the relative part orientation and function.

FIG. 2 shows the cooperative relationship of the parts along with their respective function. A stationary base member, 10, is provided having generally a rectangular shape of thin cross-section and preferrably made of a plastic material, and having at its forward end comb-type teeth projections 12 and at its other end a back plate 14. Centrally located on its inside surface 16 is fixedly attached a fastening bolt 18. Positioned on the forward end of the stationary base member, on its inside surface 16, are two bosses 20 fixedly attached to said inside surface 16, properly spaced and positioned to cooperatively engage and align a standard safety razor blade 22 at its axial alignment apertures 24 so that the blade edge projects outwardly from the base 10 equidistant with the comb-like teeth projections 12. A slidable base member 26, of generally thin rectangular shape and preferably made of a plastic material is provided to mate cooperatively with the stationary base member 10. An elongated slot 28 is provided therein to permit the fastening bolt 18 to pass through and at the same time allow travel of the slidable base member 16 forwardly and rearwardly relative to the stationary base member 10. Alignment of base members 10 and 26 is accomplished by means of two additional bosses 30, also fixedly attached to the inside surface 16 of the stationary base member 10 directly rearward from the aforementioned blade bosses 20, in combination with two shallow elongated cavities 32 located on the inside surface 34 of the slidable base member 26 adapted to cooperatively engage with the said bosses 20 and 30, thereby defining only a forward and rearward freedom of travel, obviating any rotational component of motion. A knurled knob nut 36 is screwed onto the projecting portion of the fastening bolt 18, beyond the exterior surface 38 of the slidable base member 26, thereby fastening the base members 10 and 26 together. Comb-type teeth projections 40 are provided on the forward edge of the slidable base member 26, the length of which being such as to be equidistant with the comb-type teeth projections 12 in the stationary base member when said slidable base member is fully retracted rearwardly. When said slidable base member is moved fully forwardly, said comb-type teeth projections 40 extend beyond said stationary base member comb-type teeth projections 12 by a distance defined by the linear displacement of said movement.

Figure 3:
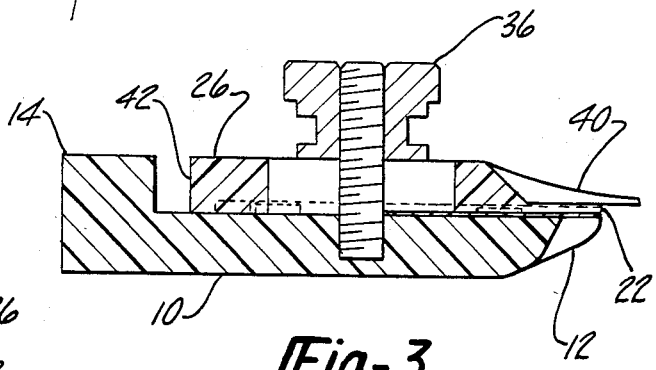
FIG. 3 is a side view of the invention along lines 3—3 in FIG. 2.

FIG. 3 is a side view showing the generally rectangular shape of base members 10 and 26, the position of the back plate 14 which mates with the rearward edge 42 of the slidable base member 26 when in the fully retracted position, and the generally concave shaping of the forward end of the slidable base member 26 and the generally convex shaping of the forward end of the stationary base member 10, both towards the plane defined by the location of the razor blade 22.

In operation, the user unscrews the knurled knob 36, separates the two base members 10 and 26, places a fresh razor blade 22 in fixed alignment with bosses 20 on the stationary base member 10, reassembles the base members, and finally reattaches the knurled knob to the fastening bolt 18.

To perform long cuts, the knurled knob is loosened, the slidable base member is forwardly moved, causing extension of its comb-like teeth projections beyond the blade edge 22, and the knurled knob then is tightened. The manner of holding and cutting is depicted in FIG. 1. To perform short cuts, the slidable base member is moved into its fully retracted position, thereby exposing the razor blade edge to the hair with a minimum of surrounding depth of cut defining comb-like teeth. However adjusted, the presence of comb-like teeth projections on both base members assures a controlled and even cut.

It is intended that the foregoing description is merely descriptive of the invention and that modifications may occur to those skilled in the art to which this invention pertains without departing from the scope of this disclosure.

I claim:

1. A lightweight, compact, adjustable, razor blade type, hand-held hair trimmer tool, comprising:

a thin substantially rectangularly shaped stationary base member, preferrably of plastic composition, having an exterior surface and an interior surface, and at one end comb-like teeth projections and at the other a back plate, further having fixedly attached to said interior surface a fastening bolt located substantially centrally thereupon, a first set of bosses for aligning and positioning a razor blade in such manner that the cutting edge of said razor blade extends substantially to the end of said comb-like teeth projections, and a second set of bosses positioned between said back plate and said fastening bolt;

a thin, substantially rectangularly shaped slidable base member, preferably made of plastic composition, having an exterior surface and an interior surface adapted to mate with said interior surface of said stationary base member, and having at one end comb-like teeth projections and at the other a truncated edge for mating with said back plate when said slidable base member is mated with said stationary base member in a fully retracted position, further having a set of elongated cavities on said interior surface of said slidable base member running in the same direction as said comb-like teeth projections, for cooperative engagement with said bosses permitting only a forward and rearward movement of said slidable base member relative to said stationary base member, and an elongated slot, running in the same direction as said comb-like teeth projections, adapted for protrusion of said fastening bolt therethrough; and a nut adapted to screw onto said fastening bolt when said stationary base member is mated to said slidable base member, thereby fastening said base members together.

2. Hair trimmer tool as recited in claim 1 wherein the stationary base member forwardly tapers convexly toward the plane defined by the position of said razor blade.

3. Hair trimmer tool as recited in claim 2 wherein the slidable base member forwardly tapers concavely toward the plane defined by the position of said razor blade.

4. Hair trimmer tool as recited in claim 3 wherein the comb-like teeth projections in both said base members tapers forwardly toward the plane defined by the position of said razor blade, forming a point along said plane.

5. Hair trimming tool as recited in claim 4 wherein the comb-like teeth projections on said slidable base member, when in fully retracted position, project substantially as far as the comb-like teeth projections on said stationary base member.

* * * * *